US012631371B2

(12) United States Patent
Powell et al.

(10) Patent No.: US 12,631,371 B2
(45) Date of Patent: May 19, 2026

(54) METHODS FOR FORMING PATHWAYS OF INCREASED THERMAL CONDUCTIVITY FOR GEOTHERMAL WELLS

(71) Applicant: NCS Multistage, LLC, Houston, TX (US)

(72) Inventors: Jesse Parker Powell, Houston, TX (US); James Gambrell King, Houston, TX (US)

(73) Assignee: NCS Multistage, LLC, Houston, TX (US)

( * ) Notice: Subject to any disclaimer, the term of this patent is extended or adjusted under 35 U.S.C. 154(b) by 0 days.

(21) Appl. No.: 19/104,514

(22) PCT Filed: Aug. 23, 2023

(86) PCT No.: PCT/US2023/030929

§ 371 (c)(1),
(2) Date: Feb. 18, 2025

(87) PCT Pub. No.: WO2024/044251

PCT Pub. Date: Feb. 29, 2024

(65) Prior Publication Data

US 2026/0071785 A1 Mar. 12, 2026

Related U.S. Application Data

(60) Provisional application No. 63/400,110, filed on Aug. 23, 2022.

(51) Int. Cl.
*F24T 10/20* (2018.01)
*E21B 34/06* (2006.01)
(Continued)

(52) U.S. Cl.
CPC ..... *F24T 10/20* (2018.05); *E21B 34/06* (2013.01); *E21B 43/267* (2013.01);
(Continued)

(58) Field of Classification Search
CPC .. E21B 2200/06; E21B 2200/02; E21B 34/06; E21B 43/267; F24T 10/20; F24T 2010/53
See application file for complete search history.

(56) References Cited

U.S. PATENT DOCUMENTS 11,953,238 B1 4/2024 Moncarz et al.
2012/0145397 A1 6/2012 Schultz et al.
(Continued)

FOREIGN PATENT DOCUMENTS

WO 2022241567 A1 11/2022

OTHER PUBLICATIONS

Thomas, S., PCT International Search Report and Written Opinion, issued Jan. 3, 2024 in connection with PCT International Application No. PCT/US2023/030929, 9 pages.

*Primary Examiner* — Yong-Suk (Philip) Ro
(74) *Attorney, Agent, or Firm* — Foley IP Law, PLLC

(57) ABSTRACT

Methods for forming pathways of increased thermal conductivity in a geothermal well are disclosed. The pathways increase heat transfer efficiency in a closed loop geothermal operation. The methods comprise injecting a thermally conductive material into the annular space between a conduit in the wellbore and the formation; forming a fracture in the formation and filling it with the thermally conductive material; and putting the well in an underbalanced state and drawing the thermally conductive material back towards a port in the conduit that is in an excluded configuration to create a pathway of increased thermal conductivity. The thermally conductive material may comprise a fluid carrier and solid particles having a high thermal conductivity.

20 Claims, 9 Drawing Sheets

(51) Int. Cl.
*E21B 43/267* (2006.01)
*F24T 10/00* (2018.01)

(52) U.S. Cl.
CPC ..... *E21B 2200/02* (2020.05); *E21B 2200/06* (2020.05); *F24T 2010/53* (2018.05)

(56) References Cited

U.S. PATENT DOCUMENTS

| | | | | |
|---|---|---|---|---|
| 2015/0300327 | A1 | 10/2015 | Sweatman et al. | |
| 2020/0190937 | A1* | 6/2020 | Nevison | E21B 43/267 |
| 2020/0191444 | A1* | 6/2020 | Nevison | F24T 50/00 |
| 2021/0095551 | A1 | 4/2021 | Johnson et al. | |
| 2022/0010664 | A1* | 1/2022 | MacPhail | E21B 43/26 |

* cited by examiner

METHODS FOR FORMING PATHWAYS OF INCREASED THERMAL CONDUCTIVITY FOR GEOTHERMAL WELLS

TECHNICAL FIELD

The disclosure relates to geothermal wells, and in particular, forming pathways of increased thermal conductivity in and/or around geothermal wells to improve heat harvesting efficiency.

BACKGROUND

Geothermal energy is the thermal energy generated and stored in the Earth. A fluid is typically either produced from a high temperature subsurface reservoir or injected into the reservoir where it is heated. When the fluid is brought back to surface, the heat can be harvested. This may involve using the heat directly (e.g., to heat buildings, homes, or greenhouses) and/or to generate electricity (e.g., using a turbine).

In a traditional geothermal system, hot water or steam is produced from a reservoir. In some systems, produced fluid directly drives a steam turbine in generation of electricity. In binary systems, heat is transferred at surface to a secondary working fluid that is used to drive a turbine to generate electricity.

More recently, Enhanced Geothermal Systems (EGS), also referred to as engineered geothermal systems, have been used to extract heat from hot reservoirs where there may be low natural permeability or fluid saturation. This concept offers great potential for dramatically expanding the use of geothermal energy into geographic areas that don't necessarily have hydrothermal reservoirs suitable for traditional geothermal systems.

Creating an EGS can involve improving the natural permeability of rock in a reservoir by creating a subsurface fracture system. This is done by injecting fluid into a well and into the reservoir under carefully controlled conditions, which causes pre-existing fractures to re-open, and in some cases also creates new fractures within the reservoir, thereby improving reservoir permeability. With increased reservoir permeability, a working fluid can be injected through the fractured rock and be transported through the reservoir to a production well where the heated working fluid is produced to surface.

The operational system may depend on the temperature of the formation, and whether the formation already carries a significant quantity of water.

Geothermal systems may be open loop or closed loop. A closed loop geothermal system continuously circulates a heat transfer working fluid through a sealed downhole conduit. The loop is filled just once and requires only a moderate amount of fluid. The fluid never comes in direct contact with the formation, but the heat is transferred through the sealed conduit via conduction. In closed loop systems, it can be difficult to obtain sufficient heat transfer into the working fluid.

In contrast, in an open loop geothermal system, the fluid is directed through the formation to collect heat directly from the rocks via convection. Open loops can be problematic because of fluid loss, corrosion, scale and so on, but have excellent heat transfer characteristics.

SUMMARY

In accordance with the disclosure, there are provided methods for forming at least one pathway of increased thermal conductivity between a formation and a wellbore in a geothermal well. The at least one pathway of increased thermal conductivity may increase heat transfer efficiency in a closed loop geothermal operation in the well.

In some embodiments, the method comprises the steps:

a. providing a conduit in the wellbore, the conduit having an internal passageway and at least one port between the internal passageway and an exterior of the conduit, wherein the at least one port is changeable between an open configuration, a closed configuration and an excluded configuration, wherein the excluded configuration restricts movement of material between the internal passageway and the exterior of the conduit;

b. inserting a thermally conductive material into at least one fracture in the formation through the at least one port in the open configuration; and c. putting the at least one port in the excluded configuration and putting the well in an underbalanced state such that the pressure in the internal passageway is less than the pressure outside the conduit, causing the thermally conductive material to move towards the at least one port that is in the excluded configuration to form the at least one pathway of increased thermal conductivity between the formation and the conduit.

In some embodiments, the method further comprises after step a):

a.i.) forming the at least one fracture by injecting a treatment fluid through the at least one port in the open configuration.

In some embodiments, the method further comprises between step a) and step a.i.):

inserting the thermally conductive material into an annular space between the outside of the conduit and the formation through the at least one port in the open configuration;

wherein in step b), the thermally conductive material moves from the annular space into the at least one fracture.

In the underbalanced state, the pressure in the internal passageway adjacent the at least one port in the excluded configuration may be lower than the pressure outside the conduit adjacent the at least one port in the excluded configuration.

The conduit may have multiple sections of at least one port, and steps b) and c) are repeated for each section.

The conduit may have multiple sections of at least one port, and steps a.i.), b) and c) are repeated for each section.

The conduit may comprise a sliding sleeve valve assembly for changing the configuration of the at least one port.

The thermally conductive material may comprise a fluid and solid particles, and in the excluded configuration of the at least one port, the solid particles of a predetermined size are prevented from moving between the internal passageway and the exterior of the conduit. The predetermined size of the particles may be at least 0.10 mm, preferably at least 0.20 mm, preferably at least 0.30 mm, preferably at least 0.40 mm, preferably at least 0.50 mm, preferably at least 0.60 mm, preferably at least 0.70 mm, preferably at least 0.80 mm, preferably at least 0.90 mm, or preferably at least 1.0 mm.

In step c), spaces between adjacent solid particles in the thermally conductive material may decrease. In step c), the surface area of contact between adjacent solid particles may increase.

The conduit may comprise a flow controller to control movement of the solid particles through the at least one port when in the excluded configuration. The flow controller may comprise at least one of a filter, a screen, a slot, a hole, a porous media, and tortuous flow path, and combinations thereof.

In step b), the thermally conductive material may be inserted into the at least one fracture with the treatment fluid. In step b), the thermally conductive material may be inserted into the at least one fracture after the treatment fluid has been injected.

The thermally conductive material may comprise any one or combination of: silicon carbide, beryllium oxide, magnesium oxide, aluminum nitride, aluminum, copper, iron, graphite, graphene, molten salts, ceramics and polymer composites.

There may be multiple ports of the at least one port, and in step c), the at least one port that is in the excluded configuration is a different port than the at least one port in step b) that is in the open configuration.

The method may further comprise the step: d) circulating a working fluid in the conduit with the at least one port in the closed configuration to extract geothermal energy from the formation.

The pathway of increased thermal conductivity may be between the formation and the conduit. The pathway of increased thermal conductivity may be between at least one fracture in the formation and the conduit. The pathway of increased thermal conductivity may be between at least a section of at least one fracture in the formation and the conduit.

BRIEF DESCRIPTION OF THE DRAWINGS

Various objects, features, and advantages of the disclosure will be apparent from the following description, as illustrated in the accompanying drawings. The drawings are not necessarily to scale, emphasis instead being placed upon illustrating the principles of various embodiments of the invention. Similar reference numerals indicate similar components.

DETAILED DESCRIPTION

Illustrative implementations of one or more embodiments of the present disclosure are provided below, including numerous details to provide a thorough understanding of the disclosure. However, it will be apparent to one skilled in the art that various modifications can be made and/or that the specific details provided are not required to practice the present disclosure. The disclosure should in no way be limited to the illustrated and described embodiments, but may be modified and be within the full, intended scope of the present disclosure. A number of possible alternative features are introduced during the course of this description. It is to be understood that, according to the knowledge and judgment of persons skilled in the art, such alternative features may be substituted in various combinations to arrive at different embodiments of the present disclosure.

As used herein, the terms "up", "upward", "upper", or "uphole", refer to positions or directions in closer proximity to the surface and further away from the bottom of a wellbore, when measured along the longitudinal axis of the wellbore. The terms "down", "downward", "lower", or "downhole" refer to positions or directions further away from the surface and in closer proximity to the bottom of the wellbore, when measured along the longitudinal axis of the wellbore.

Geothermal systems in which a working fluid is injected into a formation, heated by the formation, and then recovered is limited by the rate at which heat can be transferred from the formation to the working fluid. In a closed loop system, the rock itself may restrict the flow of heat by acting effectively as a thermal insulator. In addition, the surface area and conductivity of the conduit limits the rate at which heat is transmitted from the formation to the working fluid.

This disclosure provides solutions to the low conductivity of the rock formation by creating pathways of increased thermal conductivity between the formation and the conduit in the wellbore in which the working fluid circulates. This provides an increase in the rate of heat transfer from the reservoir to the conduit, thereby increasing the efficiency of heat extraction in the geothermal system.

Various aspects of the disclosure will now be described with reference to the figures.

Figure 1:
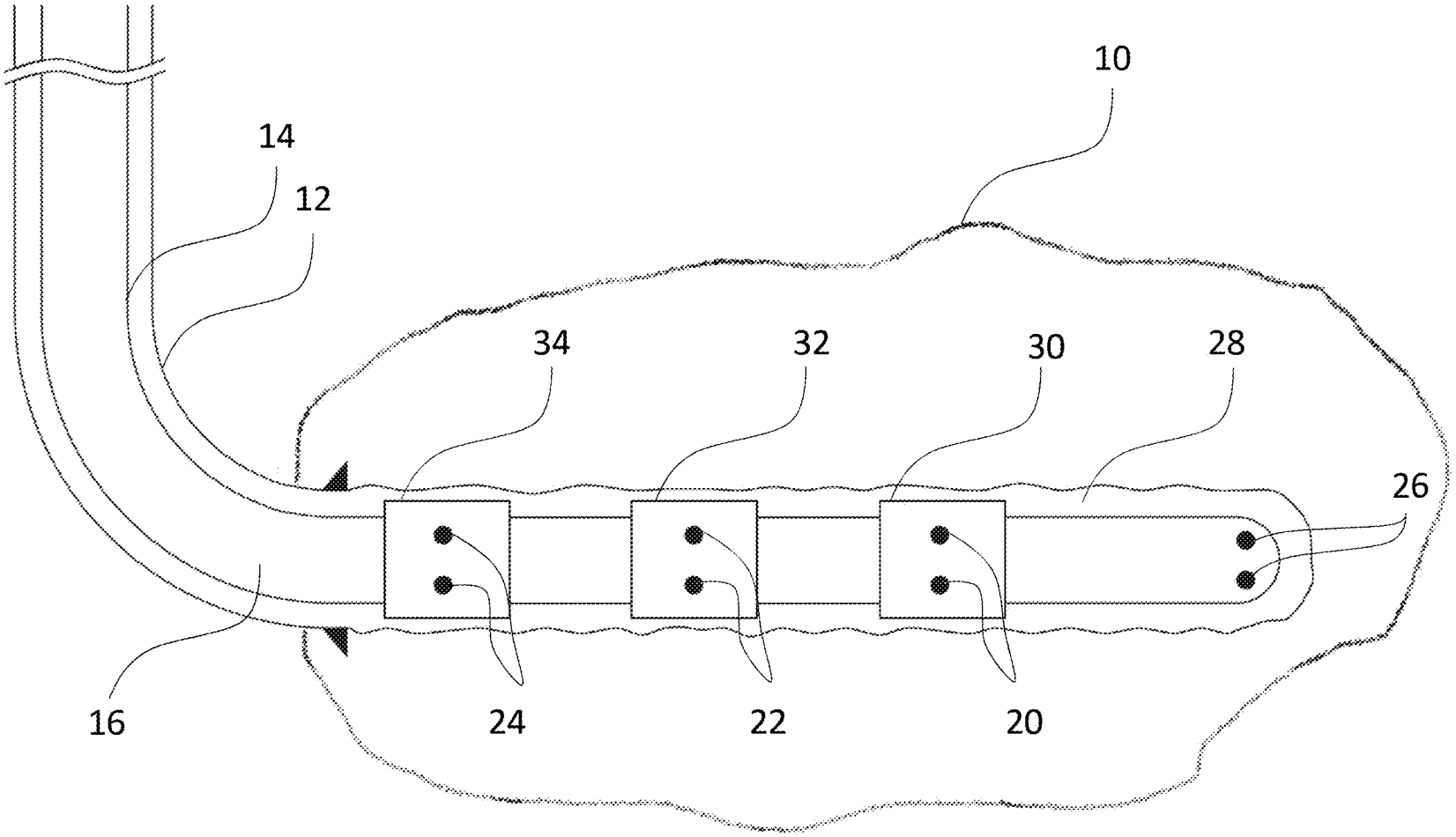
FIG. 1 is a cross-sectional diagram of a system for a closed loop geothermal well having a conduit with ports configured to fracture a formation at various points along its length and create pathways of increased thermal conductivity between the formation and conduit.

Embodiments of a system that can be used for creating pathways of increased thermal conductivity for use in a closed loop geothermal well are now described with reference to FIG. 1. FIG. 1 illustrates a formation 10 into which a wellbore 12 has been drilled. A conduit 14 has been placed in the well that allows fluid flow through an internal passageway 16 in the conduit to and from the well surface. The conduit has multiple sections of at least one port, including a first section of ports 20, a second section of ports 22, and a third section of ports 24. The ports connect the internal passageway 16 and the annular space 28 surrounding the outside of the conduit in the wellbore, adjacent the formation. The ports are preferably in the conduit wall. Each section may include one port or multiple ports. For multiple ports, the ports may be spaced annularly around the conduit wall. When there are multiple ports in a section, the configuration of the ports in the section may be changed simultaneously. The distance between sections of at least one port may depend on the properties of the thermally conductive material. In some embodiments, sections of at least one port may be about 1 meter to about 50 meters apart, or about 1 m to about 20 meters apart, or about 5 meters to about 10 meters apart.

The ports 20, 22, 24 may be changeable between an open configuration, a closed configuration and an excluded configuration. In the open configuration, fluid flow is permitted between the internal passageway 16 and the annular space 28. In the closed configuration, fluid flow is blocked between the internal passageway 16 and the annular space 28. In the excluded configuration, flow is restricted between the internal passageway 16 and the annular space 28. Restriction of flow may mean that the flow of fluid is allowed, but the movement of solid particles of a predetermined size may be prevented. The excluded configuration may prevent particles of a smaller size from flowing between the internal passageway and the annular space that would pass through the ports in the open configuration. For example, the excluded configuration may prevent particles of a thermally conductive material from moving between the internal passageway and the annular space, whereas the open configuration may allow the particles of thermally conductive material to move between the internal passageway and the annular space.

The conduit 14 may include a section of one or more toe ports 26 at or near a downhole end of the conduit. The toe ports may be changeable between an open configuration and a closed configuration. Instead of one or more toe ports, the conduit may be open at or near the downhole end, for example by having an open hole or open perforations. There may be elements that allow for the downhole end to be changeable between an open configuration and a closed configuration, as would be known in the art (e.g. a plug, a seat, or another sealing element). The downhole end, for example through toe ports, may also be changeable to an excluded configuration.

The port configuration may be changed using a sliding sleeve valve assembly. An example of a suitable sliding sleeve valve assembly is disclosed in the Applicant's U.S. Patent Publication 2022/0010664, which is hereby incorporated by reference. The sliding sleeve valve assembly may include at least one sleeve 30, 32, 34 associated with each section of ports. The sleeve may be slidable along a longitudinal axis with respect to the conduit 14 and the ports 20, 22, 24 to change the port configuration between the open, closed and excluded configuration. The sleeve may be a multicycle sleeve in which the configuration of the ports can be changed multiple times. For example, the ports can be changed from a closed configuration to an open configuration and back to a closed configuration. The configuration of the ports may be changed using any one or combination of a shifting tool, an isolating member (e.g., a ball or dart), and a rupturable member (e.g., a burst disc). Changing the ports to the closed configuration may involve isolating sections of the conduit from each other. For example, an isolation assembly may be run into the conduit to isolate a downhole section from an uphole section, causing the port(s) in one or more of the sections (e.g. the downhole section or the uphole section) to be in the closed configuration.

The sleeve may move to change the configuration of the ports. For example, the sleeve may cover the ports in the closed configuration and may uncover the ports in the open configuration. In the excluded configuration of the ports, there may be a flow controller to restrict movement of fluid. For example, there may be a flow controller positioned over the ports to prevent solid particles of a predetermined size from moving through the ports. The flow controller may comprise restricted ports, for example smaller ports than the ports of the open configuration. The flow controller may include a filter. The filter may include a screen, slots and/or holes. The filter may include a porous material. When a sliding sleeve valve assembly is used, the flow controller may be part of the sliding sleeve. The flow controller may include a tortuous flow path between the internal passageway and the annular space to restrict flow.

In some embodiments, the conduit 14 comprises a wellbore string. The wellbore string may include pipe, casing, liner, and/or various tubular segments. In some embodiments, the wellbore includes a cased-hole completion, in which case the wellbore string includes a casing. In some embodiments, the wellbore string is an open hole liner. In some embodiments, the conduit may be placed in an open hole.

Embodiments of methods for creating pathways of increased thermal conductivity in a closed loop geothermal well are described. The methods allow for effective placement of thermally conductive material to create pathways of increased thermally conductivity between a formation and a conduit. A working fluid for a closed loop geothermal well circulates in the conduit during geothermal energy extraction. The methods may minimize the spacing between adjacent particles of the thermally conductive material in the pathways, thereby maximizing the thermal conductivity in the pathways.

Figure 2:
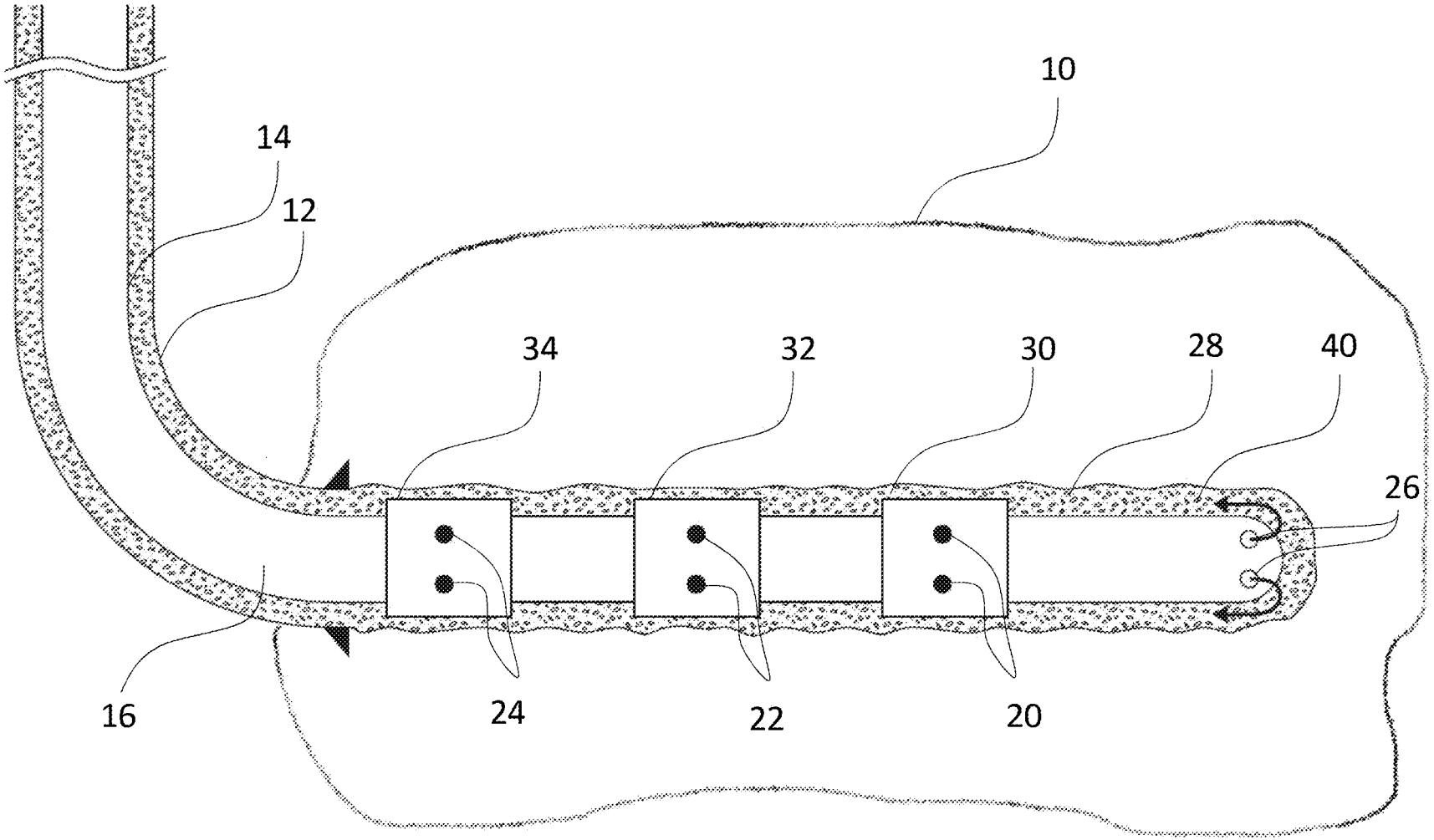
FIG. 2 is a cross-sectional diagram of the embodiment of FIG. 1, wherein a thermally conductive material has been circulated into the annular space between the conduit and the formation.

Referring to FIG. 2, a thermally conductive material 40 in a pumpable form is circulated into the annular space 28 between the conduit 14 and the formation 10. The thermally conductive material may be circulated from the well surface, down the internal passageway 16 and out one or more ports which are in the open configuration. For example, the toe ports 26 may be in the open configuration to allow the thermally conductive material to move through the toe ports into the annular space, while the other ports 20, 22, 24 are in the closed configuration. Alternatively, the thermally conductive material is circulated into the annular space through each section of ports sequentially. For example, the first section of ports 20 may be in the open configuration while the second and third sections of ports 22, 24 are in the closed configuration to allow circulation of the thermally conductive material through the first section of ports to the annular space 28 adjacent the first section of ports. Next, the first section of ports 20 are closed and the second section of ports 22 opened to circulate thermally conductive material into the annular space adjacent the second section of ports. This continues for each section of ports. The order of the opening of ports to circulate the thermally conductive material may be in any sequence. For example, the ports can be opened sequentially from the downhole end to the uphole end of the conduit, or from the uphole end to the downhole end, or an alternate order.

During circulation of the thermally conductive material, the pressure of the thermally conductive material from the surface and in the internal passageway is higher than the pressure in the annular space to cause the thermally conductive material to circulate into the annular space.

The thermally conductive material may be inserted or introduced into the annular space until the annular space is filled with the thermally conductive material. After the annular space is filled with the thermally conductive material, one or more sections of fractures in the formation may be filled with the thermally conductive material. The fractures may be existing fractures or may be created using known techniques in hydraulic fracturing to pump a treatment fluid into the formation to form the fractures. A treatment fluid is a fluid used in hydraulic fracturing operations to create or expand existing fractures in a formation to increase permeability in the formation, allowing constituents present in the formations (e.g. petroleum, natural gas, water, brine, etc.) to flow more freely in the formation. Typical treatment fluids include, but are not limited to, mixtures of primarily water that contain sand and/or other proppants. Alternatively, or in addition, the fractures may be naturally occurring fractures.

Figure 3:
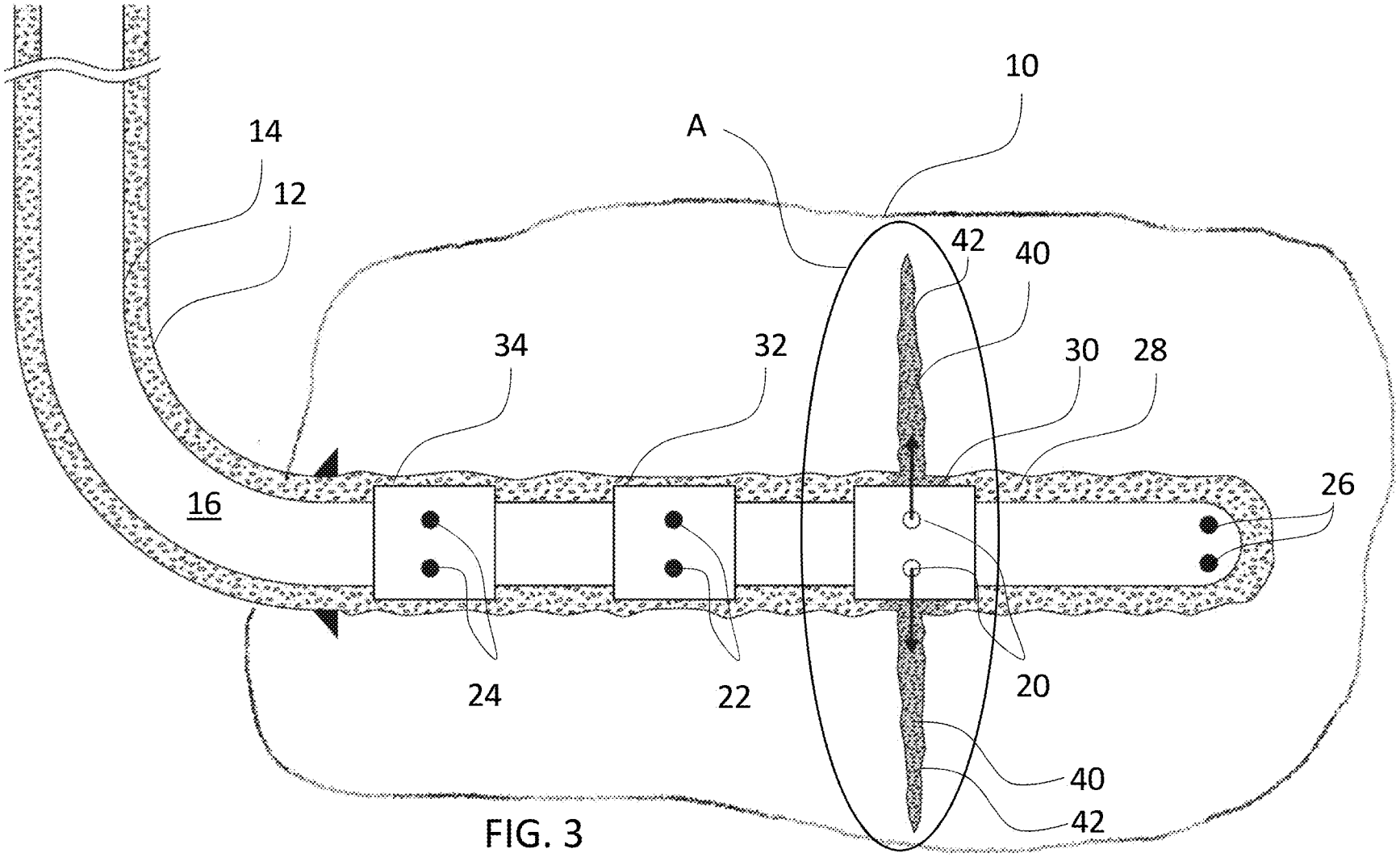
FIG. 3 is a cross-sectional diagram of the embodiment of FIG. 1, wherein a first fracture has been created and filled with a thermally conductive material through a first set of ports in an open configuration.

Referring to FIG. 3, a treatment fluid may be pumped through the conduit at a high pressure to create a first fracture 42 in the formation adjacent the conduit, referred to as hydraulic fracturing. The illustrated embodiment shows the formation of the first fracture 42 by changing the toe ports 26 to the closed configuration and changing the first section of ports 20 to the open configuration while keeping the other sections of ports 22, 24 in the closed configuration. In this configuration, injection of the treatment fluid into the internal passageway causes the first fracture 42 to open adjacent the first section of ports 20. Tip screen-out fracturing techniques may be used to limit lateral fracture growth and increase fracture aperture size.

It is to be understood that reference to a singular fracture, such as the first fracture 42, can also mean multiple fractures.

Figure 4:
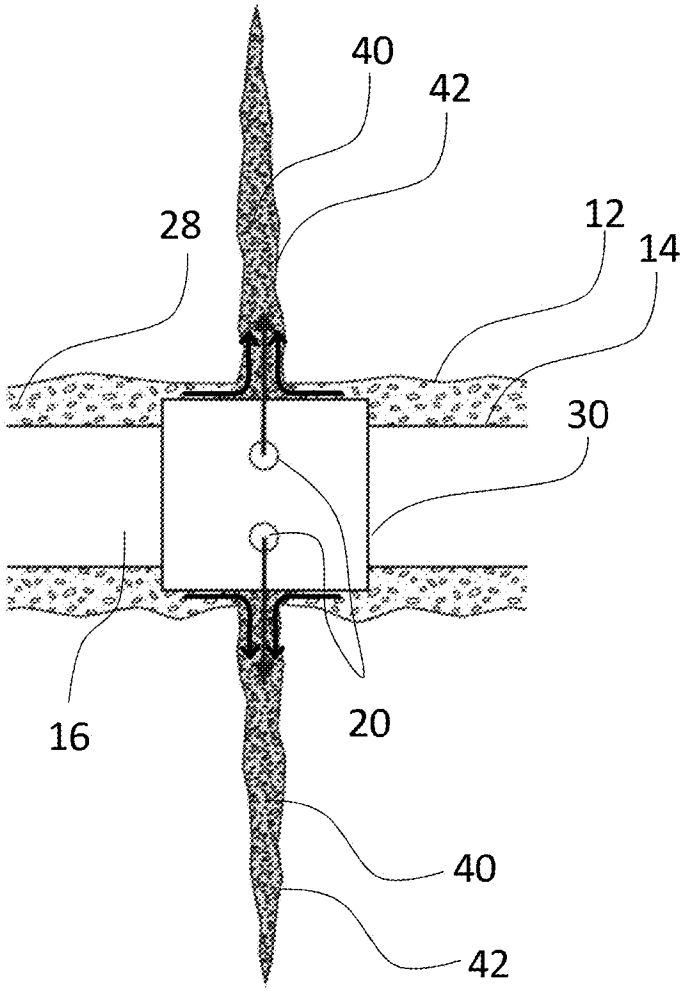
FIG. 4 is an enlarged view of section A from FIG. 3, showing the introduction of a thermally conductive material in the first fracture adjacent the first section of ports that are in the open configuration.
Figure 5:
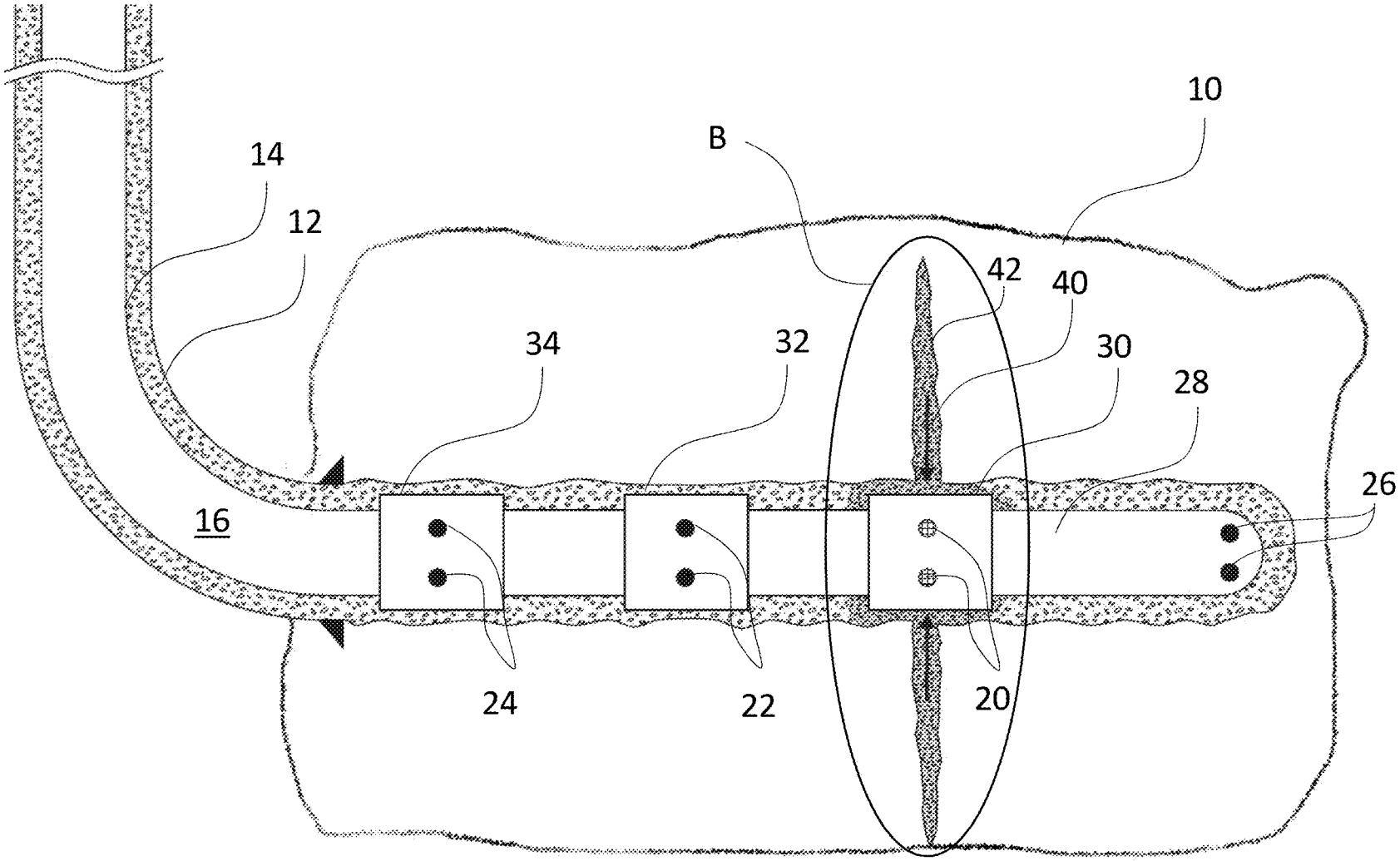
FIG. 5 is a cross-sectional diagram of the embodiment of FIG. 1, wherein the first section of ports is in an excluded configuration and the wellbore is in an underbalanced state to draw the thermally conductive material from the first fracture toward the first section of ports.

After the formation of the first fracture 42, the pressure in the conduit may be maintained at the same or a higher pressure than the first fracture to, allowing the thermally conductive material 40 to flow from the annular space 28 into the first fracture 42, as shown in FIG. 4.

Figure 6:
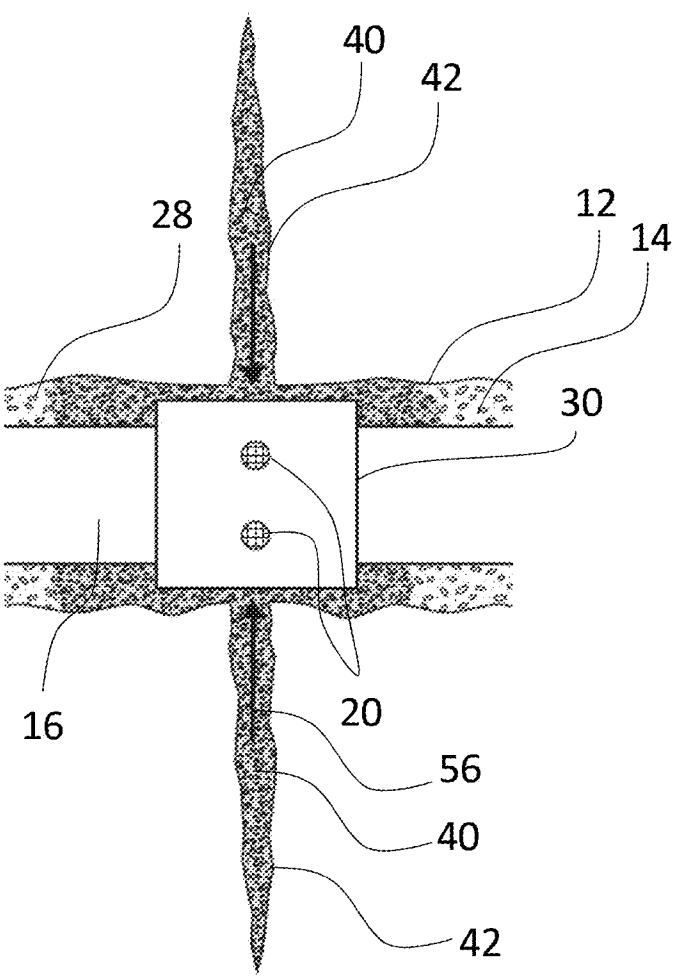
FIG. 6 is an enlarged view of section B from FIG. 5, showing the flowback of the thermally conductive material toward the first section of ports that are in an excluded configuration.

Next, the first section of ports 20 is changed to the excluded configuration, while the other ports 22, 24, 26 remain closed. The wellbore is put in an underbalanced state. In an underbalanced state, the pressure in the wellbore is lower than the pressure outside the conduit in the formation. For example, the pressure in the internal passageway adjacent the first section of ports 20 is lower than the pressure outside the first section of ports. The underbalanced state may cause flowback of the thermally conductive material from the first fracture towards the first section of ports 20. The flowback may cause the first fracture 42 to close on the thermally conductive material 40 in the first fracture and draw the thermally conductive material towards the first section of ports 20. Since the first section of ports are in the excluded configuration, the thermally conductive material is restricted from flowing back into the internal passageway 16. If the thermally conductive material contains solid particles, solid particles of a predetermined minimum size may be blocked from flowing back into the internal passageway, while any fluid in the thermally conductive material may flow into the internal passageway through the ports in the excluded configuration. This causes the solid particles that are restricted from flowing into the internal passageway to be drawn closer together, thereby decreasing the space between adjacent particles. The solid particles may accumulate around the first section of ports in the annular space and in the first fracture. This is shown in FIG. 6, wherein the thermally conductive material 40 has a higher density of solid particles in the first fracture 42 and in the annular space adjacent the first section of ports 20. Drawing the thermally conductive solid particles closer together may increase surface area contact between adjacent particles. This can reduce the porosity and the permeability of the thermally conductive material, thereby creating a pathway 56 of increased thermal conductivity. The thermal conductivity along the pathway is higher than the thermal conductivity of the formation surrounding the conduit.

Figure 7:
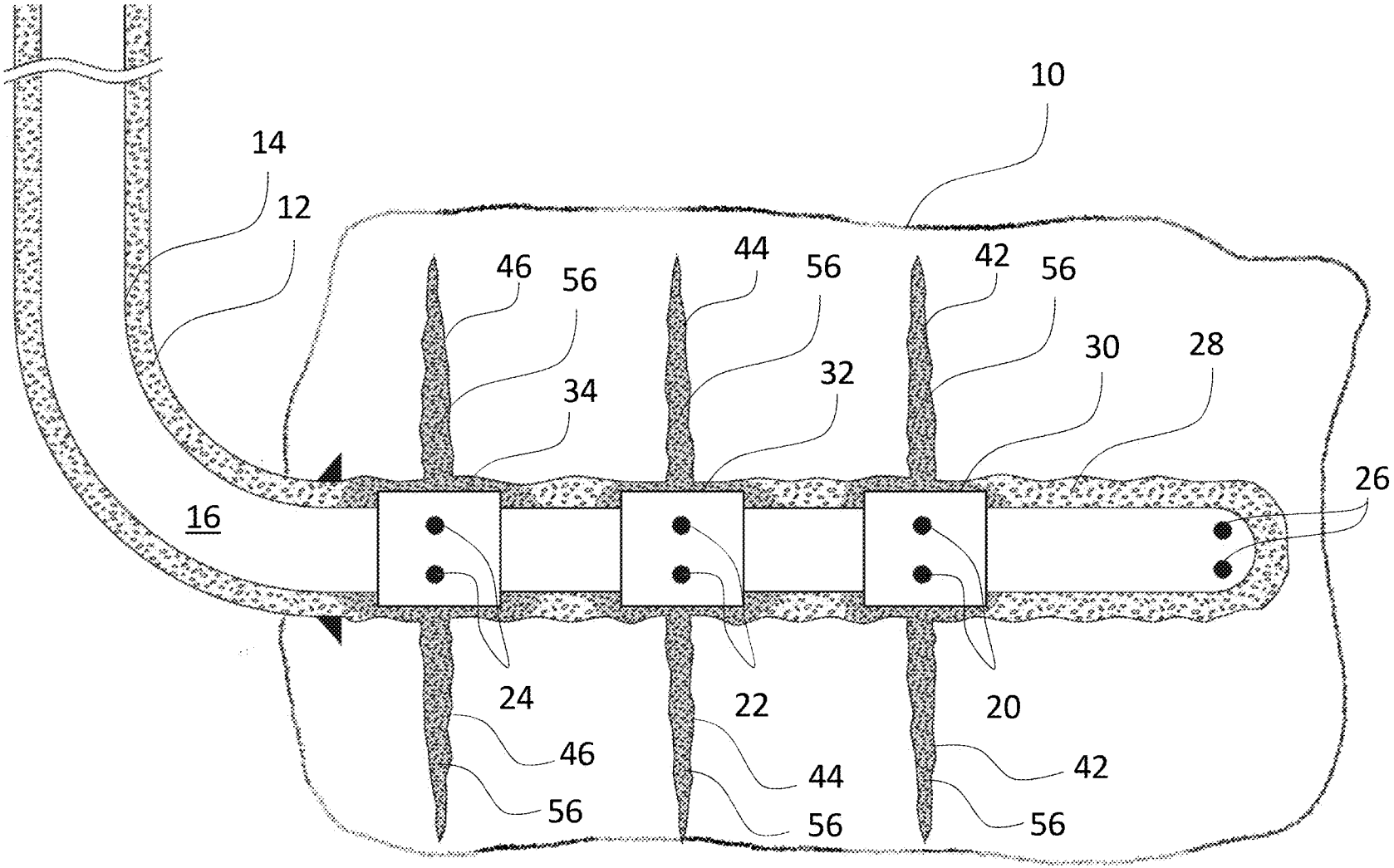
FIG. 7 is a cross-sectional diagram of the embodiment of FIG. 1, wherein fractures have been created adjacent each section of ports, and thermally conductive material has been drawn towards each section of ports to create pathways of increased thermal conductivity between the formation and the conduit such that the well is ready for circulating a working fluid for extracting geothermal energy from the formation.

The above steps of forming or opening a fracture, filling the fracture with the thermally conductive material, and putting the wellbore in an underbalanced state to draw the thermally conductive material back towards the ports may be repeated for additional sections of ports. For example, to repeat this process for the second section of ports 22, the other ports 20, 24, 26 are put in the closed configuration and the second section of ports 22 are put in the open configuration. A treatment fluid is injected to open at least one second fracture 44 to form adjacent the second section of ports 22, and the second fracture 44 is filled with the thermally conductive material. Then the second section of ports 22 are put in the excluded configuration and the wellbore put in an underbalanced state to flowback the thermally conductive material towards the second section of ports. FIG. 7 illustrates a wellbore after this process has been conducted for the first, second and third section of ports 20, 22, 24. In this embodiment, pathways 56 of increased thermal conductivity are formed between the first fracture 42 and the conduit 14, between the second fracture 44 and the conduit 14, and between the third fracture 46 and the conduit 14.

The sequence of ports for which the above steps are repeated may vary. For example, the method may start with the ports at the downhole end and move towards the uphole end, or start from the uphole end and move towards the downhole end, or the sequence may be in any other order.

Once the pathways of increased thermal conductivity are formed, as shown in FIG. 7, the well is ready to be put into production mode for a closed loop geothermal system. In the production mode, the ports 20, 22, 24, 26 may be in the closed configuration to isolate a working fluid in the conduit. The one or more pathways of increased thermal conductivity between the formation and the outside of the conduit increase the rate of heat transfer from the formation to the working fluid, thereby increasing the efficiency of the geothermal system.

Figure 10:
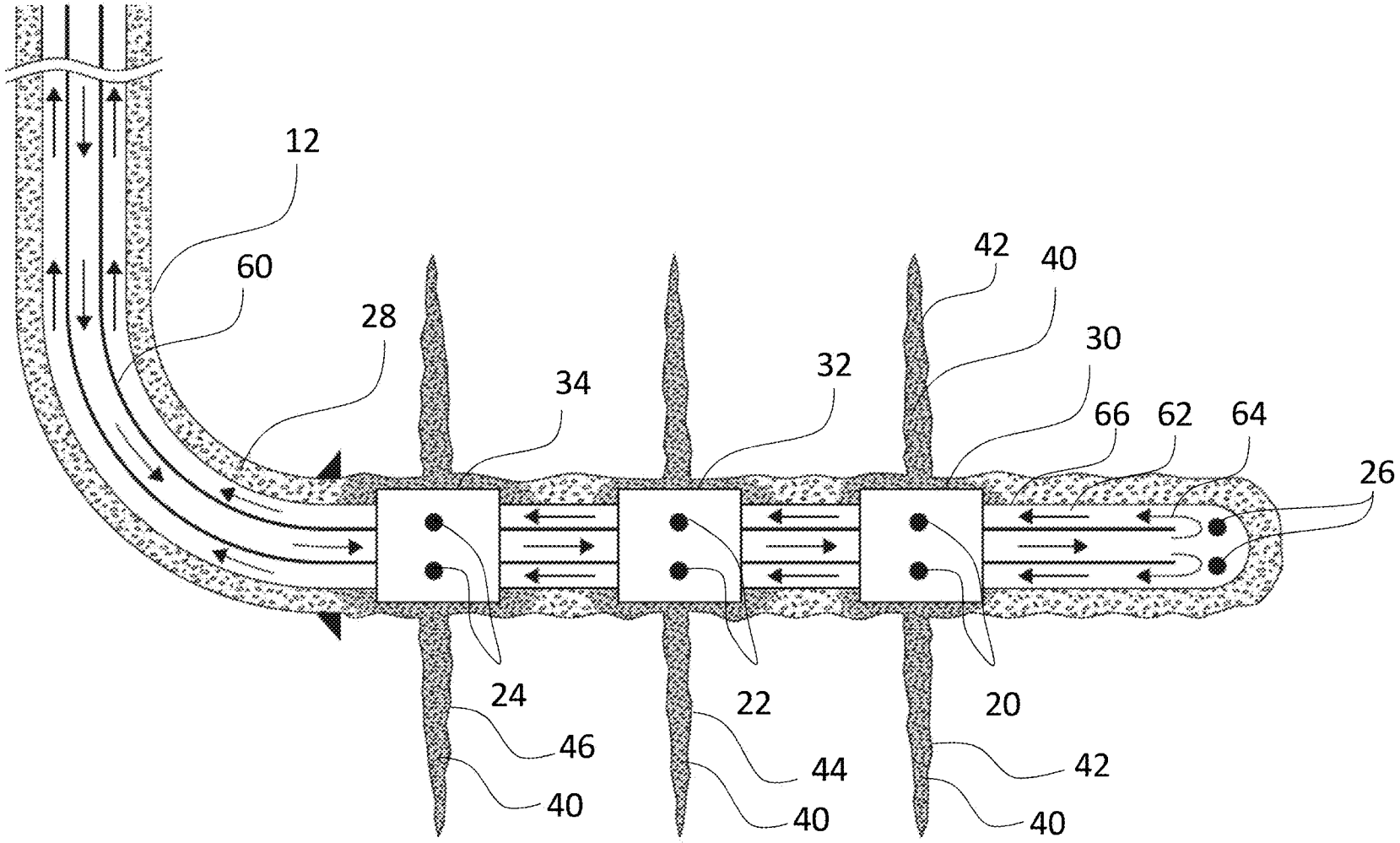
FIG. 10 is a cross sectional diagram of the embodiment of FIG. 7, wherein a pipe has been placed in the conduit for circulating a working fluid in a closed loop for the transfer of heat from the formation through the pathways of increased thermal conductivity between the formation and the conduit.

FIG. 10 illustrates one embodiment for the production mode of a closed loop geothermal well, wherein a co-axial pipe 60 has been inserted into the conduit for circulating the working fluid from the well surface to the downhole end of the conduit. The working fluid 64 can exit the pipe and flow up the annulus 62 between the pipe and the conduit back to the surface. As the working fluid flows up the annulus, heat is transferred to the working fluid through the conduit wall 66 from the formation.

Figure 8:
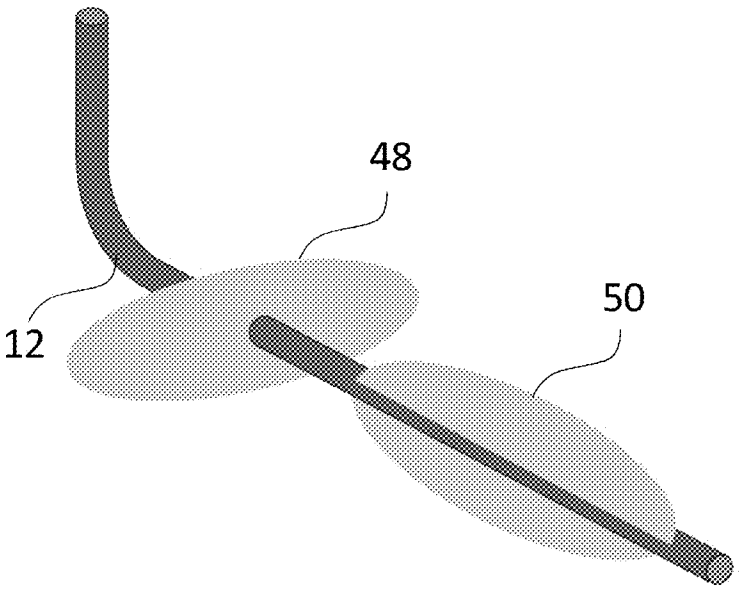
FIG. 8 is a perspective view of a wellbore with transverse and longitudinal fractures.

In the illustrated embodiments, the fractures are shown as transverse fractures that are substantially perpendicular to the wellbore. It is to be understood that the fractures may comprise longitudinal fractures that are substantially parallel to the wellbore and/or fractures at various other angles from the wellbore. FIG. 8 illustrates a wellbore 12 having both a longitudinal fracture 50 and a transverse fracture 48.

Figure 9:
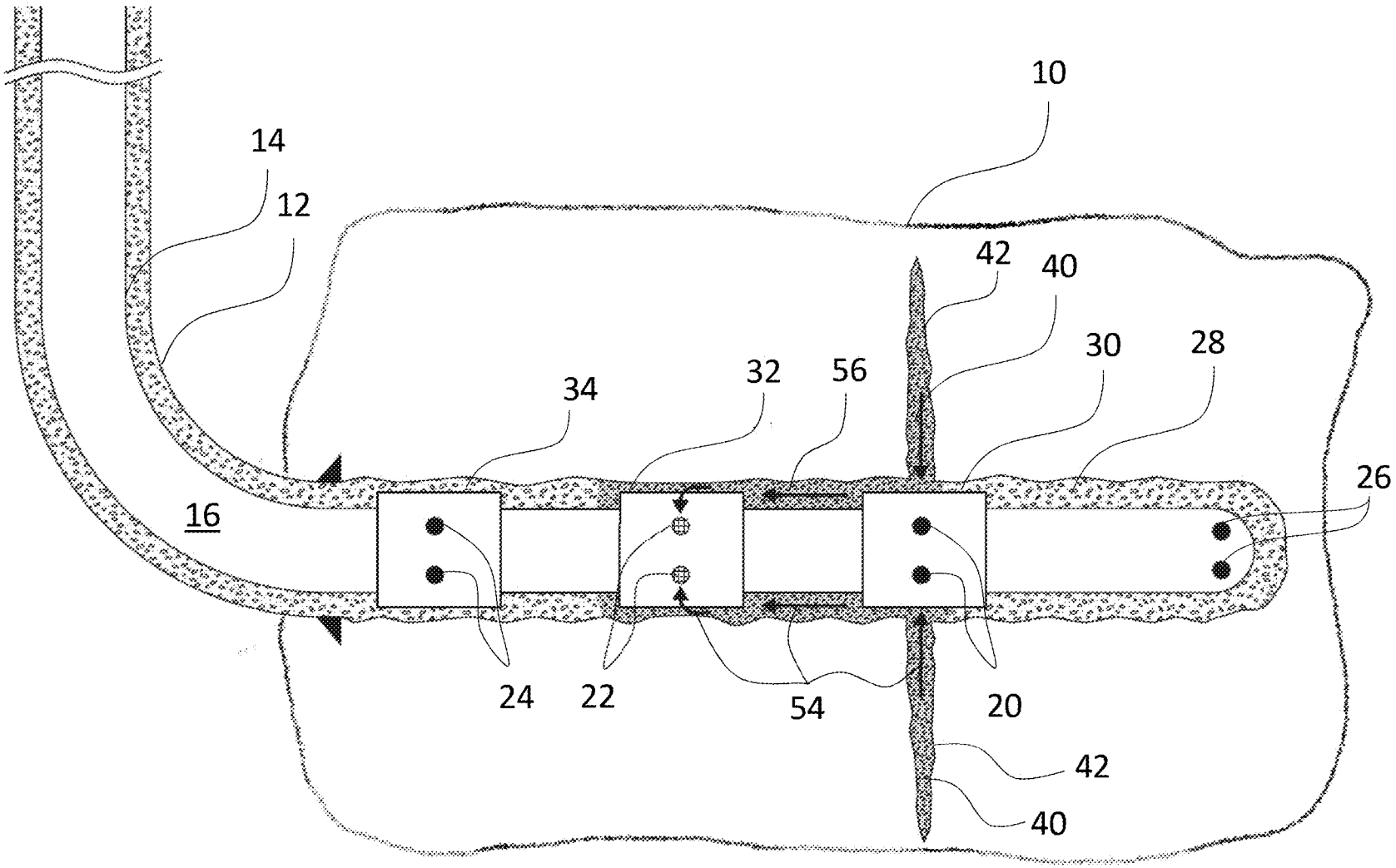
FIG. 9 is a cross-sectional diagram of the embodiment of FIG. 1, wherein there is a first fracture adjacent a first section of ports that has been filled with a thermally conductive material, and the second section of ports is in the excluded configuration while the rest of the sections of ports are in the closed configuration to draw the thermally conductive material from the first fracture towards the second section of ports.

In some embodiments, the fracture may be created by opening a first section of ports, injecting the treatment fluid and thermally conductive material, then closing the first section of ports and opening a different section of ports through which the flowback occurs. For example, FIG. 9 illustrates a first fracture 42 that has been opened by injecting a treatment fluid through the first section of ports 20. After the first fracture is opened and the thermally conductive material has flowed into the first fracture, the first section of ports 20 are changed from the open to the closed configuration, and the second section of ports 22 are changed from the closed to the excluded configuration. The well is then put in an underbalanced state, causing flowback 54 of the thermally conductive material from the first fracture 42 towards the second section of ports 22. This causes the solid particles of thermally conductive material to accumulate around the second section of ports 22, in the annular space 28 between the first section of ports 20 and the second section of ports 22, and in the first fracture 42. This accumulation creates a pathway 56 of increased thermal conductivity between the first fracture 42 and the second section of ports 22.

In some embodiments, the thermally conductive material may be injected with the treatment fluid such that it enters the fractures as they are being formed. Alternatively, or in addition, the thermally conductive material may be injected into the fractures after treatment fluid is injected, causing the fractures to fill with the thermally conductive material. The injection of the thermally conductive material with the treatment fluid and/or after the treatment fluid may be done in addition to injecting the thermally conductive material into the annular space 28. Alternatively, the injection of the thermally conductive material with the treatment fluid and/or after the treatment fluid may be done instead of injecting the thermally conductive material into the annular space 28.

In some embodiments, the thermally conductive material is pumped into natural fractures in the formation. In this case, a section of one or more ports are in the open configuration, and the thermally conductive material is injected into the fractures in the formation through the open ports. After the thermally conductive material is in the fractures, the section of one or more ports are changed to the excluded configuration, and the wellbore is put in an underbalanced position to cause flowback of the thermally conductive material from the fractures towards the internal passageway to create pathways of increased thermal conductivity between the natural fractures and the conduit.

In some embodiments, proppant is used when forming the fractures to prop the fractures open. The proppant may include a material having high thermal conductivity. In some embodiments, no proppant is used. In some embodiments, the thermally conductive material acts as a proppant.

The thermally conductive material may be in various forms and may comprise materials in one or more of solid, molten, liquid and gaseous forms. The thermally conductive material may be in a state that allows it to be pumped initially when it is circulated or injected into the formation and/or the annular space. After circulation and injection, the thermally conductive material does not need to be in a pumpable state. The thermally conductive material may comprise a slurry. The thermally conductive material may include a fluid and particles of solid material. The particles of solid material may have high thermal conductivity. The fluid may have high thermal conductivity. The fluid may comprise an aqueous and/or a non-aqueous fluid.

It is noted that thermal conductivity of a material corresponds to a measure of that material's ability to conduct heat. Therefore, it should also be noted that, as used herein, the expression "high thermal conductivity" can refer to materials, be it in solid, molten, liquid or gaseous form, having a greater thermal conductivity relative to the formation (e.g., rock formation) adjacent to, or in close proximity to the pathways of increased thermal conductivity. Therefore, it should be readily understood that the thermally conductive material can have a high thermal conductivity, corresponding to a thermal conductivity which is greater than the thermal conductivity of the rock formation adjacent to, or in close proximity to, the pathways of increased thermal conductivity created using the thermally conductive material.

Selecting a thermally conductive material may include identifying potential materials with known or reported thermal conductivity that exceeds expected thermal conductivity for the formations in which the wellbore is situated. A "buffer" can be employed by choosing materials with significantly larger reported thermal conductivities as compared to thermal conductivity values for particular types of rock formations. For example, pure copper possesses a thermal conductivity of ~401 W/m/K, which far exceeds reported thermal conductivities for rock formations, such as Wilcox sandstones which does not exceed 5.73 W/m/K. Employing a powder of pure copper would be expected to provide the increased thermal conductivity pathways based on these reported values.

Alternatively, selecting a thermally conductive material may include assessing core plugs within the formation containing the wellbore and assessing thermal conductivity according to ASTM D5334. Based on the values obtained for the core plugs, a thermally conductive material may be chosen based on known or reported values, or a sample preparation of the thermally conductive material (solid, liquid, slurry, paste, etc.) may also be assessed using ASTM D5334 to determine the relative thermal conductivity.

In some embodiments, the thermal conductivity of the thermally conductive material can be greater than the thermal conductivity of the rock formation adjacent to, or in close proximity to the pathways of increased thermal conductivity created using the thermally conductive material by any possible and/or suitable extent. For instance, in some embodiments, the thermal conductivity of the thermally conductive material can be at least 10%, 20%, 30%, 40%, 50%, 60%, 70%, 80%, 90% or 100% greater than the thermal conductivity of the rock formation adjacent to, or in close proximity to the pathways of increased thermal conductivity created using the thermally conductive material.

It is noted that the efficiency of the geothermal system can be increased by an increase of the rate of heat transfer from the formation to the working fluid, among others. Therefore, in some embodiments, the thermally conductive material can be selected based on a desired or "targeted" heat transfer rate. It is also appreciated that other parameters or properties of the geothermal system, including the surrounding formation, can be monitored and/or measured, at any point during downhole operations, to assist in selecting the thermally conductive material. For example, the temperature of any one component, or combination of components, of the geothermal system, including the surrounding formation, can be monitored.

The thermally conductive material may form pathways that have a thermal conductivity greater than the thermal conductivity of the rock formation adjacent to, or in close proximity to, said pathways. For example, thermal conductivity of core plugs from Wilcox sandstones in south Texas in the Gulf of Mexico sedimentary basin between 2.06 W/m/K and 5.73 W/m/K. Therefore, forming at least one pathway of increased thermal conductivity in a wellbore located in Wilcox sandstones in south Texas in the Gulf of Mexico sedimentary basin would require selecting a thermally conductive material that would comprise a thermal conductivity greater than 5.73 W/m/K. It should be apparent to the person skilled in the art that the higher the thermal conductivity of the thermally conductive material relative to 5.73 W/m/K the more efficient the geothermal well would become.

It should be noted that the thermal conductivity of the thermally conductive material can be measured at surface, e.g., in a controlled environment, or downhole, e.g., during operation of the geothermal system. It is noted that, for some material, the thermal conductivity can be substantially the same, whether measured at surface or downhole. However, in some embodiments, and for some materials, the thermal conductivity can be different when measured at surface and when measured downhole. Therefore, it is appreciated that the thermally conductive material can be selected based on its measured thermal conductivity at surface and/or measured thermal conductivity downhole. Alternatively, the thermally conductive material can be selected based on its measured thermal conductivity at surface, to which a "buffer" is added to ensure having a downhole thermal conductivity which is greater than the thermal conductivity of the rock formation adjacent to, or in close proximity to the pathways of increased thermal conductivity created using the thermally conductive material.

In some embodiments, the thermally conductive material includes solid particles having a thermal conductivity value, as measured by ASTM D5334, of at least (i.e., greater than) 10 W/m/K, at least 25 W/m/K or at least 50 W/m/K. In some embodiments, the thermally conductive material includes solid particles having a thermal conductivity, as measured by ASTM D5334, of at least 100 W/m/K, in some embodiments at least 200 W/m/K, in some embodiments at least 500 W/m/K, in some embodiments at least 750 W/m/K, and in some embodiments at least 1000 W/m/K.

Suitable materials for the solid particles may include any one or combination of silicon carbide, beryllium oxide, magnesium oxide, aluminum nitride, aluminum, copper, iron, graphite, graphene, molten salts, ceramics, and polymer composites.

The thermally conductive material may include solid particles that are prevented from moving between the internal passageway and the formation when the ports are in the excluded configuration. The size of particles that are excluded may be at least 0.10 mm, at least 0.20 mm, at least 0.30 mm, at least 0.40 mm, at least 0.50 mm, at least 0.60 mm, at least 0.70 mm, at least 0.80 mm, at least 0.90 mm, or at least 1.0 mm.

In some embodiments, the thermally conductive material can have a thermal conductivity provided in a range of about 10 W/m/K and about 2500 W/m/K, although other ranges of values are possible. In some embodiments, the thermal conductive material comprises a slurry and the thermal conductivity refers to the thermal conductivity of the slurry prior to pumping downhole. In some embodiments, the thermally conductive material comprises one or more components that are solid, liquid, gaseous or molten in form, and the thermal conductivity value refers to the thermal conductivity of one or more of the solid, liquid, gaseous or molten components.

In some embodiments, the thermally conductive material does not include a settable material that sets or cures, such as a cement, polymer, resin or other solidifying pumpable material. This allows the thermally conductive material to be redistributed after it has been introduced into a fracture or annular space. For example, redistribution of the thermally conductive material can occur when a port is put in an excluded configuration and the well is put in an underbalanced state to draw the thermally conductive material towards the port in the excluded configuration.

In some embodiments, the thermally conductive material has low permeability that minimizes or prevents the flow of fluid through the pathway of increased thermal conductivity.

The systems and methods of this disclosure may be suitable for use in a closed loop geothermal well. The geothermal well may be in various types of formations, including sedimentary, igneous, or metamorphic rock. The pressure of the formation may range from low to high pressure. The geothermal well may be a shallow or deep well. The downhole temperature of the geothermal well may have a temperature of about 50° C. or higher, 100° C. or higher, 150° C. or higher, 200° C. or higher, or 400° C. or higher.

Numerous modifications and variations of the present disclosure are possible in light of the above teachings. It is therefore to be understood that within the scope of the appended claims, the disclosure may be practiced otherwise than as specifically described herein.

The invention claimed is:

1. A method of forming at least one pathway of increased thermal conductivity between a formation and a wellbore in a geothermal well comprising the steps:

a) providing a conduit in the wellbore, the conduit having an internal passageway, at least one port between the internal passageway and an exterior of the conduit, and a sliding sleeve valve assembly for changing a configuration of the at least one port, wherein the at least one port is changeable between an open configuration, a closed configuration and an excluded configuration, wherein the excluded configuration restricts movement of material between the internal passageway and the exterior of the conduit;

b) introducing a thermally conductive material into at least one fracture in the formation through the at least one port in the open configuration, wherein the thermally conductive material comprises a fluid and solid particles and in the excluded configuration of the at least one port, the solid particles of a predetermined size are prevented from moving between the internal passageway and the exterior of the conduit; and c) putting the at least one port in the excluded configuration and putting the well in an underbalanced state such that the pressure in the internal passageway is less than the pressure outside the conduit, causing the thermally conductive material to move towards the at least one port that is in the excluded configuration and for the solid particles to accumulate at the exterior of the conduit around the at least one port and the at least one fracture to form the at least one pathway of increased thermal conductivity between the formation and the conduit.

2. The method of claim 1, further comprising after step a):

a.i.) forming the at least one fracture by injecting a treatment fluid through the at least one port in the open configuration.

3. The method of claim 2, further comprising between step a) and step a.i.):

introducing the thermally conductive material into an annular space between the outside of the conduit and the formation through the at least one port in the open configuration;

wherein in step b), the thermally conductive material moves from the annular space into the at least one fracture.

4. The method of claim 1, wherein the conduit has multiple sections of at least one port, and steps b) and c) are repeated for each section.

5. The method of claim 1, wherein the predetermined size of the particles is at least 0.10 mm.

6. The method of claim 1, wherein in step c), spaces between adjacent solid particles in the thermally conductive material decreases.

7. The method of claims 1, wherein in step c), the surface area of contact between adjacent solid particles increases.

8. The method of claims 1, wherein the conduit comprises a flow controller to control movement of the solid particles through the at least one port when in the excluded configuration.

9. The method of claim 8, wherein the flow controller comprises at least one of a filter, a screen, a slot, a hole, a porous media, and a tortuous flow path, and combinations thereof.

10. The method of claim 1, wherein in step b), the thermally conductive material is introduced into the at least one fracture with the treatment fluid.

11. The method of claim 2, wherein in step b) the thermally conductive material is introduced into the at least one fracture after the treatment fluid has been injected.

12. The method of claim 1, wherein the thermally conductive material comprises any one or combination of: silicon carbide, beryllium oxide, magnesium oxide, aluminum nitride, aluminum, copper, iron, graphite, graphene, molten salts, ceramics and polymer composites.

13. The method of claim 1, wherein there are multiple ports of the at least one port, and in step c), the at least one port that is in the excluded configuration is a different port than the at least one port in step b) that is in the open configuration.

14. The method of claim 1, further comprising the step:

d) circulating a working fluid in the conduit with the at least one port in the closed configuration to extract geothermal energy from the formation.

15. The method of claim 1, wherein the thermally conductive material-has a thermal conductivity of at least 10 W/m/K measured by ASTM D5334.

16. The method of claim 1, wherein the thermally conductive material-has a thermal conductivity of at least 100 W/m/K measured by ASTM D5334.

17. The method of claim 1, wherein the thermally conductive material-has a thermal conductivity of at least 500 W/m/K measured by ASTM D5334.

18. The method of claim 1, wherein the thermally conductive material-has a thermal conductivity of at least 1000 W/m/K measured by ASTM D5334.

19. The method of claim 1, wherein the formation comprises a formation thermal conductivity, and wherein the thermal conductivity of the thermally conductive material is greater than the formation thermal conductivity.

20. The method of claim 19, wherein the thermal conductivity of the thermally conductive material is greater than the formation thermal conductivity of the formation adjacent to, or in close proximity to the at least one pathway of increased thermal conductivity.

* * * * *